US006042440A

United States Patent [19]

Ettl

[11] Patent Number: 6,042,440

[45] Date of Patent: Mar. 28, 2000

[54] RESCUE TUBE WITH RETRACTABLE SHOULDER STRAP

[75] Inventor: Jay Ettl, Muncie, Ind.

[73] Assignee: Water Safety Products, Indian Harbour Beach, Fla.

[21] Appl. No.: 09/163,483

[22] Filed: Sep. 30, 1998

[51] Int. Cl.[7] ..... B63C 9/08

[52] U.S. Cl. ..... 441/88

[58] Field of Search ..... 441/80, 84, 85, 441/89

[56] References Cited

U.S. PATENT DOCUMENTS 5,480,332 1/1996 Cynamon ..... 441/88

FOREIGN PATENT DOCUMENTS 2246745 2/1992 United Kingdom ..... 441/88

*Primary Examiner*—Jesus D. Sotelo

*Attorney, Agent, or Firm*—Rader, Fishman & Grauer; Ronald P. Kananen

[57] ABSTRACT

A water rescue device includes a flotation member, a shoulder strap, an extension strap which connects the floatation member and the shoulder strap, and a slack eliminator, which is connected to the extension material, and mechanically coils any slack extension strap between the flotation member and the shoulder strap, the slack eliminator having a torsion spring, a reel which takes up any slack extension strap under a force of the torsion spring, a plastic housing, and a selectively operable cam lever which allows the extension strap to extend a desired length against the force of the torsion spring.

11 Claims, 3 Drawing Sheets

RESCUE TUBE WITH RETRACTABLE SHOULDER STRAP

BACKGROUND OF THE INVENTION

The rescue tube is among the most used pieces of active/passive victim rescue equipment by aquatic professionals. It's versatility, ease of use, and softness have made it a popular choice in many waterparks in America. Several variations of the popular tube design can be used in different situations.

A typical rescue tube includes a floatation member, connected to a thick shoulder strap by several feet of strap material which allows a lifeguard to get the flotation member to an active victim struggling in the water even if that person is beyond the lifeguard's normal reach. The shoulder strap may be a loop of strap material that is large enough to fit around a lifeguard's head and one shoulder.

A problem with a typical rescue tube lies in the slack strap material that hangs from the member or flotation device when the lifeguard is watching swimmers. In the event of an emergency such as an active or passive victim drowning in the water, the lifeguard must be able to immediately leave the lifeguard stand or deck and jump into the water. The slack strap material can, and commonly does get caught on the lifeguard stand, or other surrounding objects, i.e., fences, chairs, rope bollards, etc., resulting in a painful hanging incident causing pain and a potential for severe damage to the lifeguard. A further result is the impedance of the lifeguard to aid the struggling person in the water.

It is therefore an object of the present invention to allow a lifeguard to quickly and safely leave a lifeguard stand in the case of an emergency without risk of injury due to slack strap material being hung up on a lifeguard stand, or other surrounding objects.

SUMMARY OF THE INVENTION

The above-described needs and others are met by a water rescue device, which includes a flotation member, a shoulder strap, an extension strap which connects the flotation member and the shoulder strap, and a slack eliminator, which is connected to the extension material, and mechanically coils any slack extension strap between the flotation member and the shoulder strap. The slack eliminator may include a torsion spring, a reel, which takes up any slack extension strap under a force of the torsion spring, and a plastic housing, which contains the torsion spring and the take up reel. The torsion spring is formed of stainless steel. A selectively operable release lever may be included to allow the extension strap to be released against the force of the torsion spring.

An opening may be included on an outer surface of the flotation member, through which the extension strap is drawn from the slack eliminator, while the slack eliminator is held in a cavity within the floatation member. The flotation member may be made at least in part, of foam material, and surrounded in part by a vinyl coating. The flotation member may also include a joiner for one end of the flotation member with the opposite end.

DESCRIPTION OF THE PREFERRED EMBODIMENT

Figure 1:
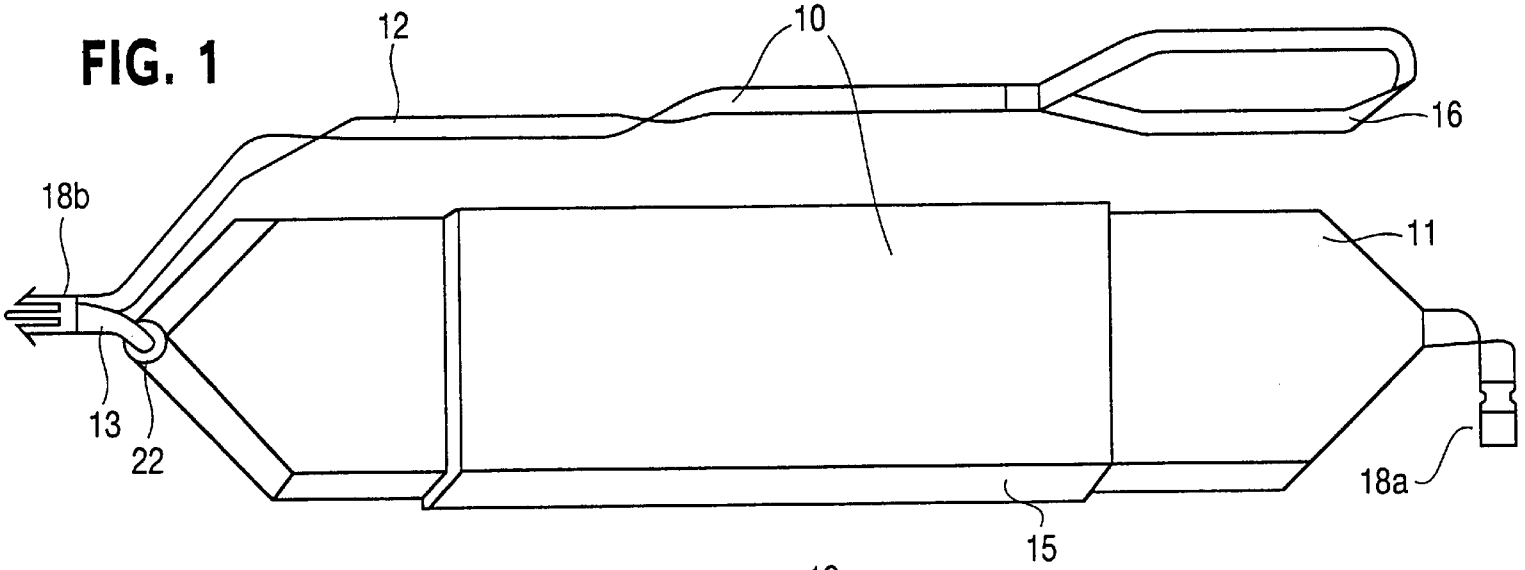
FIG. 1 shows a water rescue device with a retractable shoulder strap according to a first embodiment of the invention.
Figure 2:
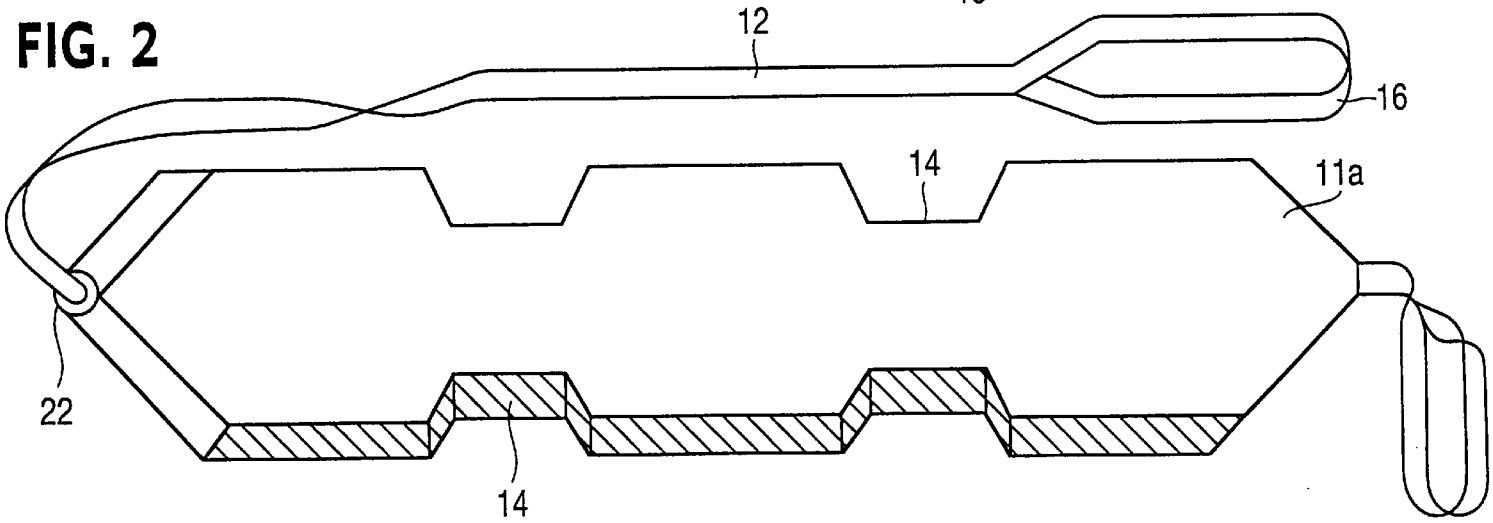
FIG. 2 shows a water rescue device with a retractable shoulder strap according to a second embodiment of the invention.
Figure 3:
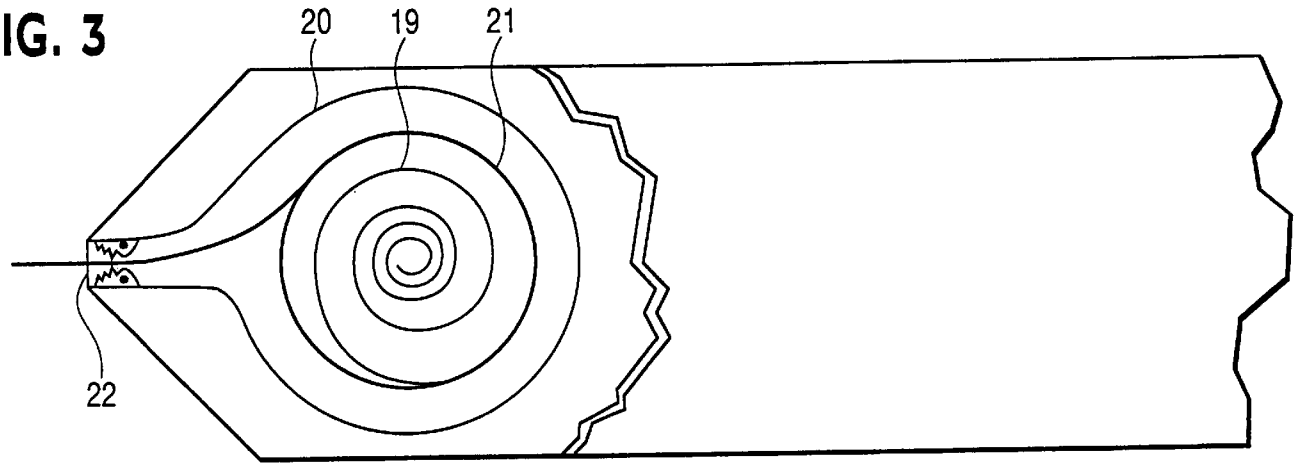
FIG. 3 shows a water rescue device with a retractable shoulder strap according to either embodiment of the invention, with a cutaway showing the strap retracting mechanism.

The above described needs are met by the water rescue device shown in FIGS. 1 to 3. FIG. 1 shows a water rescue device 10 according to the first embodiment of the invention. The water rescue device 10 includes a flotation member 11 which is tossed or otherwise extended to an active or passive victim in an emergency situation. The flotation member 11 is connected to a shoulder strap 12 by an extension strap 13. FIG. 2 shows a flotation member 11*a* that includes cut-outs 14 which allow a struggling swimmer to easily grip the flotation member 11*a*. The flotation member 11 is made, at least in part, of foam material. During a rescue, an active victim often will nervously grab at the flotation member 11. Furthermore, in rescue practices, the middle portion of the flotation device 11 is the area most likely to become worn out through repeated grabbing at this vulnerable area. Accordingly, the flotation member 11 in FIG. 1 is surrounded in part by a vinyl coating 15 which extends the life of the flotation member.

The flotation member 11 shown in FIG. 2 includes a reach assist loop 16 at an end of the flotation member 11 opposite that of the extension strap 13, which is held by the lifeguard when the victim is nearby. A joiner 18*a*, 18*b* may be included on the flotation member 11, shown in FIG. 1, and on the extension member 13, which brings one end of the flotation member 11 near the opposite end. When the joiner 18*a*, 18*b* is used, the flotation member 11 can be wrapped around the active/passive victim to ease in pulling them to safety.

Figure 4:
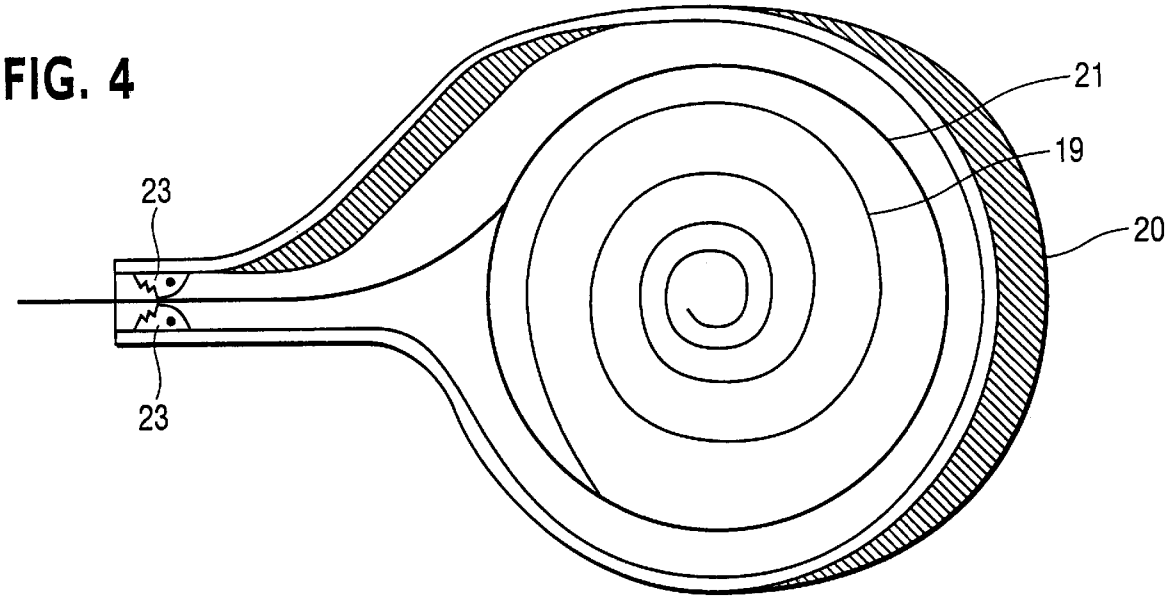
FIG. 4 shows a close-up view of the strap retra mechanism, apart from the water rescue device.

A slack eliminator 18 is shown in FIGS. 3 and 4. The slack eliminator 18 includes a torsion spring 19 that is wound inside a plastic housing 20. The torsion spring 19 provides a force that mechanically coils any slack extension strap 13 existing between the flotation member 11 and the shoulder strap 12. The force of the torsion spring 19 acts on a reel 21, which in turn rotates to take up any slack extension strap 13. The torsion spring is formed of stainless steel. One or more cam levers 23 may be included inside the plastic housing 20 to hold the extension strap 13 at a desired extension length, against the force of the torsion spring 19. An opening 22 is provided on a surface of the flotation member 11, through which the extension strap 13 is drawn from the slack eliminator 18.

Figure 5:
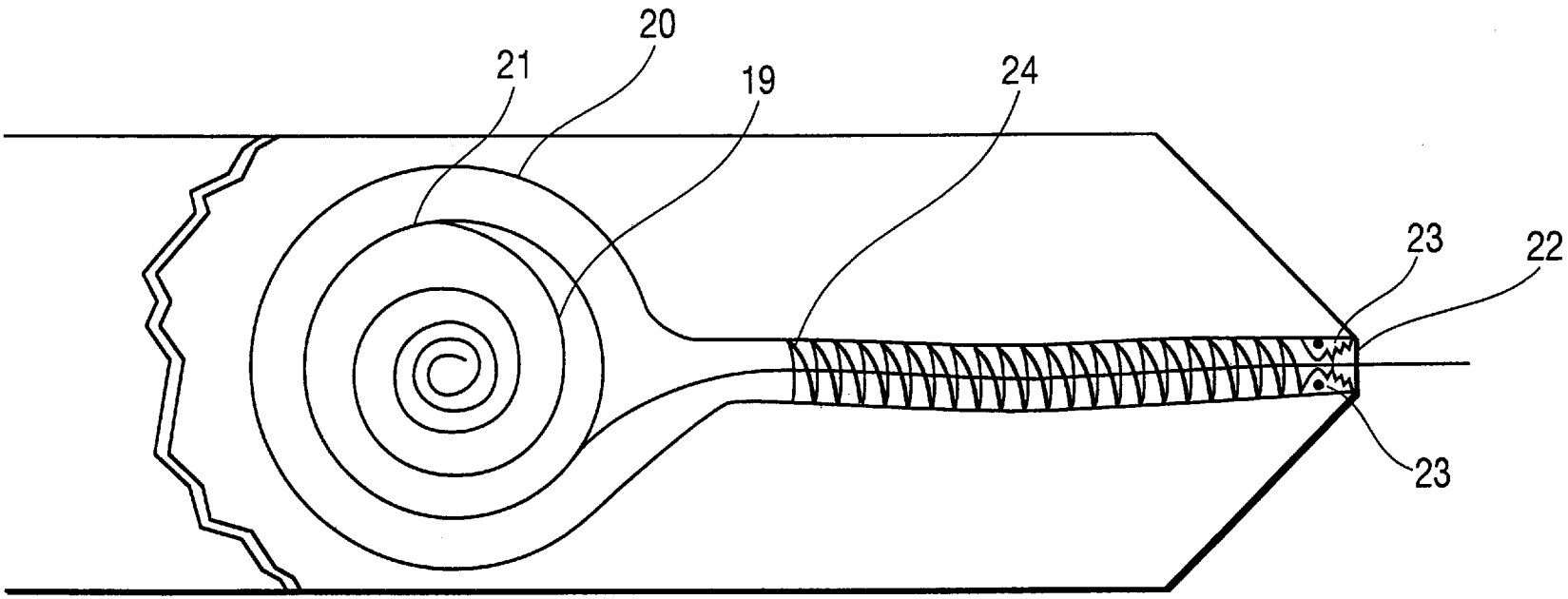
FIG. 5 shows a water rescue device with a retractable shoulder strap according to either embodiment of the invention, with a cutaway showing the strap retracting mechanism and a protective tubing for the strap.

As shown in FIG. 5, the strap 13 may be guided and protected by a bilge tubing 24 which extends from the opening 22 through which the strap 13 extends, to the slack eliminator 18. A ¾ inch bilge tubing 24 is used in a preferred embodiment of the invention, and housed within the cavity of the flotation member 11.

Having described an embodiment of the invention, it is to be understood that the invention is not limited to any of the precise embodiments described herein. Various changes and modifications could be effected by one skilled in the art without departing from the spirit or scope of the invention as defined in the appended claims.

What is claimed is:

1. A water rescue device, comprising:

a floatation member;

a shoulder strap;

an extension strap, connecting said flotation member and said shoulder strap; and a slack eliminator, which is connected to said extension strap, and mechanically coils any slack extension strap between said flotation member and said shoulder strap.

2. A water rescue device according to claim 1, wherein said slack eliminator comprises:

a torsion spring;

a reel, which takes up said extension strap under a force of said torsion spring; and a plastic housing, containing said torsion spring and said take up reel.

3. A water rescue device according to claim 2, wherein said flotation device comprises an opening on an outer surface, through which said extension strap is drawn from said slack eliminator, said slack eliminator being held in a cavity within said flotation member.

4. A water rescue device according to claim 2, wherein said torsion spring is formed of stainless steel.

5. A water rescue device according to claim 1, wherein said flotation member comprises foam material, at least of a portion of which is surrounded by a vinyl coating.

6. A water rescue device according to claim 1, wherein said flotation member comprises means for joining a first end of said flotation member with a second end of said flotation member.

7. A water rescue device according to claim 2, further comprising means for allowing a selective length of said extension strap to extend from said flotation member, against the force of said torsion spring.

8. A water rescue device according to claim 7, wherein said means for allowing said extension strap to extend from said flotation member is a selectively operable cam lever.

9. A water rescue device according to claim 1, further comprising a reach assist loop, attached to said flotation member.

10. A water rescue device according to claim 1, further comprising a strap protector, held in a cavity of said flotation member.

11. A water rescue device according to claim 10, wherein said strap protector is a bilge tubing.

* * * * *